United States Patent [19]

Hall

[11] Patent Number: 4,940,199

[45] Date of Patent: Jul. 10, 1990

[54] SUPPORT FOR EATING UTENSILS

[76] Inventor: Anson L. Hall, 22 Daggett Rd., Attleboro, Mass. 02703

[21] Appl. No.: 371,702

[22] Filed: Jun. 23, 1989

[51] Int. Cl.[5] ..... A47G 21/14

[52] U.S. Cl. ..... 248/37.3; 248/174

[58] Field of Search ..... 248/37.3, 174, 176, 248/37.6; 211/13, 60.1, 70.6, 70.1; 206/572, 565; 312/204, 206; 30/296 A, 296 R; 47/74, 73

[56] References Cited

U.S. PATENT DOCUMENTS

| | | | |
|---|---|---|---|
| 72,009 | 12/1867 | Foster | 248/37.3 |
| D. 292,861 | 11/1987 | Dorper | D7/73 |
| 1,886,075 | 11/1932 | Zorsch | 211/70.7 |
| 2,299,829 | 10/1942 | Feddersen | 248/174 |
| 2,889,127 | 6/1959 | Rossi | 211/73 X |
| 3,239,177 | 3/1966 | Samsing | 248/174 |
| 3,382,986 | 5/1968 | Pfeiffer | 248/174 X |
| 3,690,620 | 9/1972 | Matson | 248/459 X |
| 4,770,379 | 9/1988 | Estvold | 248/174 X |
| 4,834,328 | 5/1989 | Hall | 248/37.3 |

FOREIGN PATENT DOCUMENTS

| | | | |
|---|---|---|---|
| 1025356 | 3/1953 | France | 248/37.3 |
| 243914 | 12/1925 | United Kingdom | 248/37.3 |

*Primary Examiner*—J. Franklin Foss

*Attorney, Agent, or Firm*—Salter & Michaelson

[57] ABSTRACT

A support for eating utensils is preferably integrally blanked from a cardboard material and it includes a support frame having front and rear edges and a central support portion which extends upwardly and rearwardly from the front edge and then downwardly and further rearwardly to the rear edge. The support further includes a first bottom wall which extends rearwardly from the front edge, a second bottom wall which extends forwardly from the rear edge beneath the first bottom wall, and a retaining tab on the second bottom wall which is received in a slot along the front edge. The central support portion has an aperture formed therein which is dimensioned for receiving one or more eating utensils so that the eating or blade portions thereof are maintained in upwardly spaced relation to a supporting surface. The aperture in the central support portion preferably includes an oval-shaped main portion which is adapted for receiving the eating end portion of a spoon and/or a fork and a slot portion which is adapted for receiving the blade portion of a knife in an on-edge disposition wherein it is angled inwardly slightly in its upward extent.

6 Claims, 2 Drawing Sheets

SUPPORT FOR EATING UTENSILS

BACKGROUND AND SUMMARY OF THE INVENTION

The instant invention relates to eating utensils and more particularly to a disposable support which is adapted to be easily and effectively assembled for supporting a set of eating utensils on a counter-top, tabletop or the like.

As set forth in the applicants co-pending U.S. patent application number 07/143,171, it has recently been found that there is a significant need for an effective disposable device for supporting one or more eating utensils on a tabletop, countertop or the like both prior to and between periods of use. In this regard, it has been found that eating utensils can frequently become contaminated with bacteria and other foreign substances when they are placed on surfaces such as counter-tops or table-tops both prior to and/or between periods of use. Nevertheless, heretofore in most eating establishments, such as cafeterias, sandwich shops and fast food restaurants, where food is often served in paper or synthetic wrappings without plates, it has generally been common practice to either place utensils directly on counter-tops or table-top surfaces or to place them on paper napkins which, when removed, leave any utensils placed thereon directly on counter-top or table-top surfaces. This problem has been further compounded by the fact that in order to cut costs many eating establishments have reduced the amounts of plateware, including plates, saucers, etc, which is used in serving meals to their customers. The device disclosed in the applicant's above mentioned co-pending U.S. patent application was developed to fulfill this need and has been found to be highly effective for supporting eating utensils. However, despite its effectiveness, in some instances the device disclosed in the applicant's above mentioned co-pending U.S. patent application has been found to be difficult or awkward to assemble from a collapsed position to an erected position. Further, because of this it has been found that in some cases restaurant service personnel fail to provide their customers with utensil rests.

Devices representing the closest prior art to the subject invention of which the applicant is aware are disclosed in the patents to Dodge U.S. Pat. No. 227,224; Moore U.S. Pat. No. 799,612; Fresh U.S. Pat. No. 1,264,914; Soybel U.S. Pat. No. 1,647,154; Zorsch U.S. Pat. No. 1,886,075; Feddersen Et Al U.S. Pat. No. 2,299,829; Pickering U.S. Pat. No. 2,354,968; Lunde U.S. Pat. No. 2,567,817; Lee U.S. Pat. No. 2,789,349; Mullins U.S. Pat. No. 2,651,927; Gray U.S. Pat. No. 2,615,318; Pfeiffer U.S. Pat. No. 3,382,986; Brown No. DES 196,133 and Dorper No. DES 292,861. However, while these references are believed to be generally related to the support for eating utensils of the instant invention, they fail to disclose or suggest a support having the unique closure assembly and/or the uniquely configured aperture of the support of the instant invention and accordingly, they are believed to be only of general interest with respect thereto.

The instant invention provides an effective support for eating utensils which is adapted to be readily and easily assembled to an erected position and to effectively remain in an assembled or erected position both prior to and during periods of use. Specifically, the support for eating utensils of the instant invention comprises an elongated support frame which is made from a substantially rigid sheet material and includes elongated substantially parallel first and second edges and a central support portion which extends upwardly and rearwardly from the first edge and then downwardly and further rearwardly to the second edge. The central support portion has an aperture formed therein which is adapted for receiving and supporting an eating utensil therein and the support further includes a first bottom wall which is hingeably attached to the support frame along the first edge and extends rearwardly toward the second edge and a second bottom wall which is hingeably attached to the support frame along the second edge and extends forwardly toward the first edge beneath the first bottom wall. The support has an open slot formed therein which extends along a portion of the first edge and it further includes a tab on the second bottom wall which is receivable in the slot in the first edge for maintaining the support in an assembled position. The support frame preferably meets the first bottom wall at an acute angle along the first edge and it preferably meets the second bottom wall at an acute angle along the second edge. The slot preferably extends along a distance of less than approximately 75% of the first edge and the support frame preferably extends arcuately upwardly from the first edge to a center line and then arcuately downwardly to the second edge. The support frame, the first bottom wall, the second bottom wall and the tab are preferably integrally blanked from a cardboard sheet material and the first and second bottom walls are preferably hingeably attached to the support frame along score lines. The tab is also preferably attached to the second bottom wall along a score line. The aperture in the support frame preferably includes a substantially oval-shaped main portion which is elongated in a direction substantially parallel to the first and second edges and a slot portion which is elongated in a direction extending toward the first and second edges. The slot portion is preferably angled inwardly slightly in its upward extent from the first and second edges in order to maintain the blade of a knife received therein in a slightly inwardly angled position so that the device does not tip over from the weight of the knife. The oval-shaped main portion preferably has a major axis which is substantially coextensive with the uppermost line of the support frame and the slot portion of the aperture preferably merges with the main portion at one end of the major axis thereof.

It has been found that the support for eating utensils of the instant invention can be quickly and easily assembled to an erected position and it has been further found that once it has been assembled, the support can be effectively utilized for supporting one or more eating utensils both prior to and between periods of use. It has been still further found that the support of the instant invention can be economically and easily manufactured from a single sheet of cardboard material and that the tab can be readily and easily assembled in the slot on the first edge to retain the utensil rest in an erected position. In this regard, once the tab has been assembled in the slot, it engages the inner side of the support frame so that support frame, the first bottom wall and the tab effectively cooperate to retain the support in an assembled or erected position. Further, because of the unique configuration of the aperture in the support frame, the support for the eating utensils can be readily and easily blanked from a single sheet of cardboard material and it can be effectively utilized for supporting a pair of eating utensils. Specifically, the support can be utilized for supporting a pair of utensils, such as a spoon and a knife with the spoon received in the ovalshaped main portion of the aperture and the knife received in the slot portion. When a spoon and a knife are assembled on the utensil support in this manner, the spoon is supported in a readily accessible stable disposition and the knife is supported in an on-edge, slightly angled disposition wherein it can be easily grasped by a user.

Accordingly it is a primary object of the instant invention to provide an effective support for eating utensils which can be readily blanked from a single sheet of cardboard material.

Another object of the instant invention is to provide an effective disposable support for eating utensils which can be readily and easily assembled to an erected position and which effectively remains in an erected position once assembled.

An even further object of the instant invention is to provide a support for eating utensils including a support frame having a single aperture therein which is adapted for supporting a pair of eating utensils.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
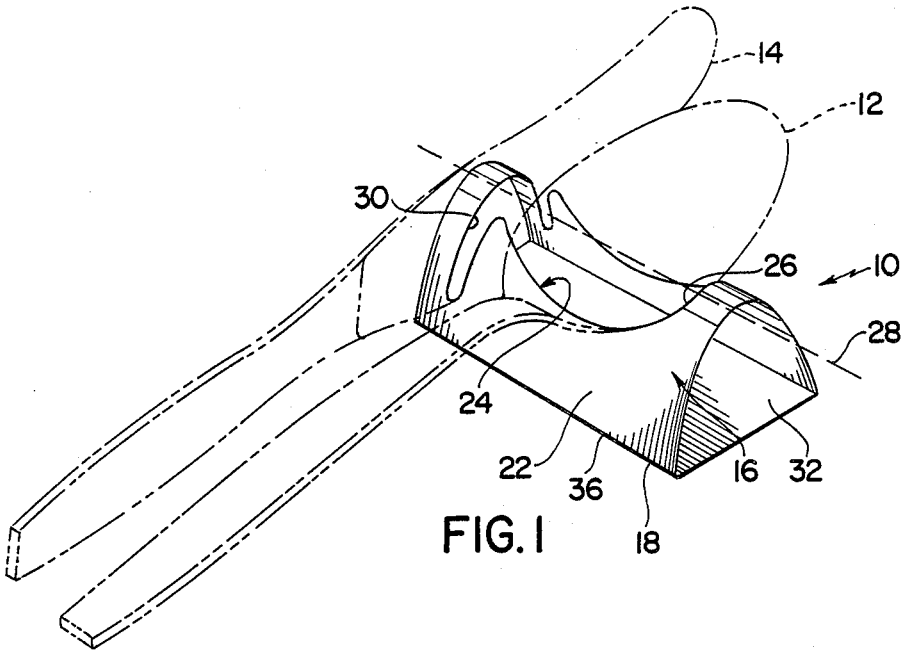
FIG. 1 is a perspective view of the support for eating utensils of the instant invention in an assembled position.
Figure 2:
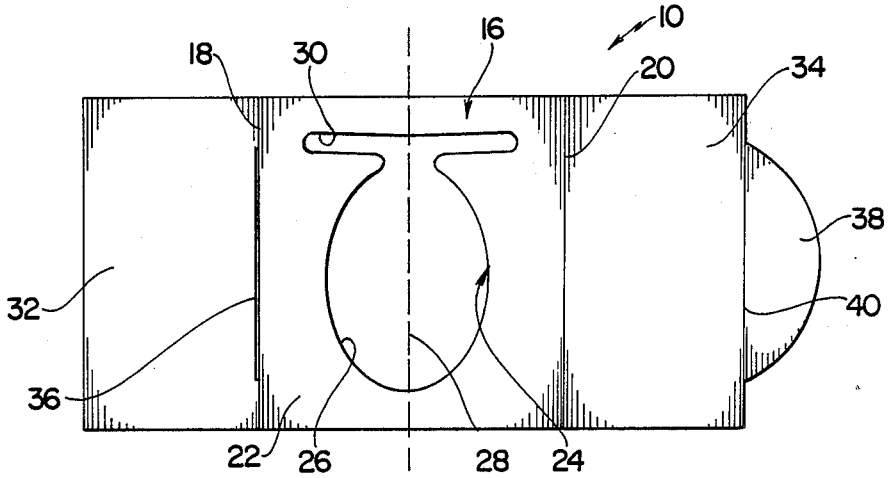
FIG. 2 is a top plan view of the support in a unassembled position.
Figure 3:
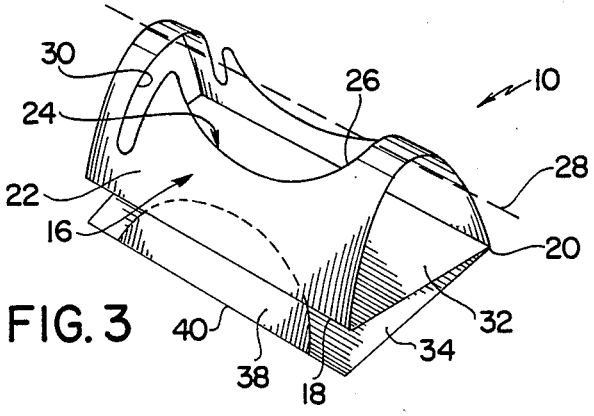
FIG. 3 is a perspective view illustrating the assembly of the tab in slot.

Referring now to the drawings, a first embodiment of the support for eating utensils of the instant invention is illustrated and generally indicated at 10 in FIGS. 1–3. This support 10 is preferably integrally blanked from a suitable substantially rigid sheet material, such as cardboard, and it is adapted to be received on a supporting surface so that it can be utilized for supporting a pair of eating utensils, such as a spoon 12 and a knife 14. Specifically, the support is adapted for supporting a spoon 12 and a knife 14 so that the eating end portion of the spoon 12 and the cutting end portion of the knife 14 are maintained in upwardly spaced relation to the supporting surface in order to prevent them from being contaminated by residual foreign substances on the supporting surface.

The support 10 comprises a support frame generally indicated at 16 which includes substantially parallel spaced first and second edges 18 and 20, respectively and a central support portion 22. The support frame 16 is preferably blanked from a substantially flat rectangular sheet as illustrated in FIG. 2 and it has an aperture generally indicated at 24 formed therein which is adapted for receiving and supporting the utensils 12 and 14. Specifically, the aperture 24 includes an oval-shaped main portion 26 having an elongated major axis which is located along a center line 28 which is substantially parallel to the first and second edges 18 and 20. The aperture 24 preferably further includes an elongated slot portion 30 which extends angularly outwardly and downwardly from the center line 28 and merges with the main portion 26 at one end of the major axis of the main portion 26. The utensil rest 10 further includes a first bottom wall 32 which is hingeably attached to the support frame 16 along a score line which extends along the first edge 18 and a second bottom wall 34 which is of substantially the same dimension and configuration as the first bottom wall 32 and hingeably attached to the support frame 16 along a score line which extends along the second edge 20. The first bottom wall 32 and the support portion 22 cooperate to define an open slot 36 which extends along a distance of less than approximately 75% of the longitudinal extend of the first edge 18. A tab 38 is intergrally attached to the second bottom wall 34 along a score line 40 which is substantially parallel to the edges 18 and 20. The tab 38 is dimensioned to be received in the slot 36 in order to retain the support 10 in the erected position illustrated in FIG. 1 wherein the first bottom wall 32 overlies the second bottom wall 34 and wherein the second bottom wall 34 defines the bottom surface of the support 10. As illustrated, when the support 10 is assembled in this manner the support portion 22 extends arcuately upwardly from the first edge 18 to the center line 28 and then arcuately downwardly to second edge 20.

It has been found that the utensil support 10 can be easily assembled from the collapsed position illustrated in FIG. 2 to the assembled position illustrated in FIG. 1 and that once it has been assembled, the support 10 can be effectively utilized for supporting a pair of utensils, such as the spoon 12 and the knife 14 on a supporting surface. It has been further found that once the utensil support 10 has been fully assembled so that the first bottom wall 32 overlies the second bottom wall 34 and the tab 38 is received in the slot 36, the tab 38 presses against the inner side of the support portion 22 so that it is more effectively retained in the slot 36. In this regard, because the support 10 is integrally made from a cardboard material, the tab 38 inherently tends to resiliently return to a position wherein it is substantially parallel to the second bottom wall 34. This causes the tab 38 to be resiliently urged against the inner side of the support portion 22 when the support 10 is in the assembled position thereof. Further, when the support 10 is utilized for supporting a pair of utensils, such as the spoon 12 and the knife 14, the weight of the utensils 12 and 14 inherently urges the support frame 16 downwardly to further retain the tab 38 in the slot 36.

Figure 4:
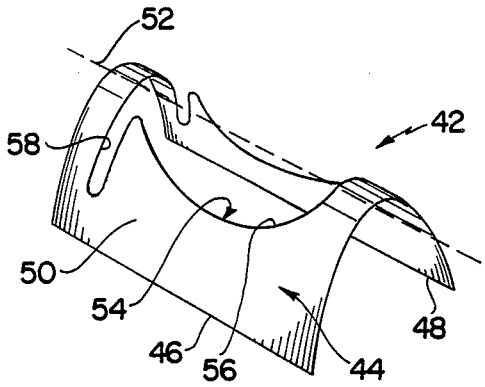
FIG. 4 is a perspective view of a second embodiment of the support.
Figure 5:
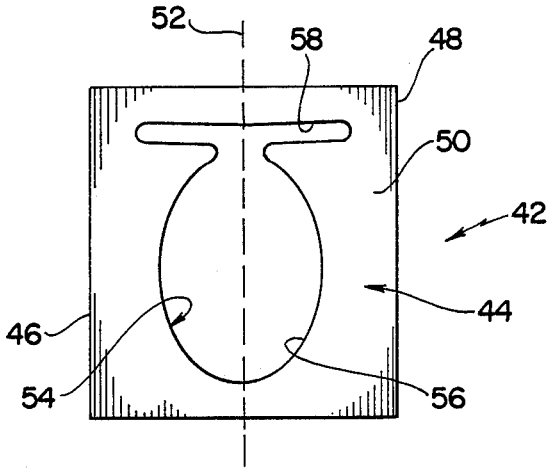
FIG. 5 is a top plan view of the second embodiment in a collapsed position.

Referring now to FIGS. 4–5, a second embodiment of the support for eating utensils of the instant invention is illustrated and generally indicated 42. The support 42 comprises a support frame generally indicated at 44 including first and second elongated substantially parallel edges 46 and 48 respectively, and a central support portion 50. The support portion 50 is preferably formed from a substantially rectangular sheet material, such as a foldable plastic material which substantially retains its configuration once formed into a desired shape. It has been found that various foldable plastic materials can be utilized for this purpose as well as cardboard materials which have been reinforced with bendable reinforcing wires. The support portion 50 is adapted so that it can be bent to the arcuate configuration illustrated FIG. 4 wherein it extends arcuately upwardly from the first edge 46 to a center line 52 and then arcuately downwardly to the second edge 48. The center line 52 is preferably disposed midway between the edges 46 and 48 and it preferably defines the uppermost extremity of the support 42 when the support 42 is in the assembled position illustrated in FIG. 4. The support portion 50 has an aperture generally indicated at 54 formed therein including a elongated oval-shaped main portion 56 and an elongated slot portion 58 which extends downwardly and slightly angularly outwardly from the center line 52. The main portion 56 is preferably oriented so that the major axis thereof is substantially coextensive with the center line 52 and the slot portion 58 is preferably oriented so that it angles downwardly and slightly outwardly from the center line 52. Further, the slot portion 58 preferably merges with the main portion 56 at one end of the major axis of the main portion 56 as illustrated.

It has been found that the support for eating utensils 42 can also be effectively utilized for supporting a pair of eating utensils, such as the utensils 12 and 14 on a supporting service. In this regard, once the support frame 44 has been bent or formed to the configuration illustrated in FIG. 4 it effectively retains it shape so that a pair of utensils can be supported on the edges of the aperture 54 in a manner similar to that illustrated in FIG. 1 with respect to the support 10.

It is seen therefore that the instant invention provides an effective support for eating utensils. The supports 10 and 42 can both be effectively utilized for supporting utensils in the apertures 24 and 54 thereof, respectively. Further, the supports 10 and 42 are both of relatively simple construction so they can be manufactured relatively economically from disposable materials such as cardboard or plastic. Still further, the support 10 includes the tab 38 which is readily and easily receivable in the slot 36 in order to retain the support 10 in an assembled position both prior to and during periods use. Accordingly, for these reasons it is seen that the utensil support of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A support for eating utensils comprising an elongated support frame made from a substantially rigid sheet material and including elongated substantially parallel first and second edges and a central support portion extending upwardly from said first edge and then downwardly to said second edge, said central support portion having an aperture therein which is adapted for receiving and supporting an eating utensil, a first bottom wall hingeably attached to said support frame along said first edge and extending toward said second edge said first bottom wall and said support frame cooperating to define an open slot which extends along a portion of said first edge, a second bottom wall hingeably attached to said support frame along said second edge and extending toward said first edge, said second bottom wall being disposed beneath said first bottom wall, said support frame meeting said first bottom wall at an acute angle along said first edge and meeting said second bottom wall at an acute angle along said second edge, and tab means on said second bottom wall received in said slot for maintaining said support in an assembled position, said support frame, said first bottom wall, said second bottom wall and said tab means being integrally formed from a substantially flat rigid sheet.

2. In the support of claim 1, said support frame extending arcuately upwardly from said first edge and then arcuately downwardly to said second edge.

3. In the support of claim 1, said aperture including a substantially oval-shaped main portion which is elongated in a direction substantially parallel to said first and second edges and a slot portion which is elongated in a direction extending toward said first and second edges.

4. In the support of claim 1, said aperture including a substantially oval shaped main portion having a major axis which is substantially parallel to said first and second edges, said major axis having opposite ends, and a slot portion which extends outwardly in opposite directions from said axis toward said first and second edges, said slot portion merging with said main portion at one of said ends of said major axis.

5. In the support of claim 4, said support frame extending arcuately upwardly from first edge to an uppermost line which is substantially parallel to said first and second edges and then arcuately downwardly to said second edge, said major axis being substantially coextensive with said uppermost line.

6. In the support of claim 1, said first and second bottom walls being hingeably attached to said support frame along score lines which extend along said first and second edges, respectively, said tab means being hingeably attached to said bottom wall along a score line.

* * * * *